United States Patent [19]

Gammon

[11] Patent Number: 4,923,019

[45] Date of Patent: May 8, 1990

[54] THERMOCHEMICAL PENETRATOR FOR ICE AND FROZEN SOILS

[75] Inventor: Peter H. F. Gammon, St. John's, Canada

[73] Assignee: Arctic Systems Limited, St. John's, Canada

[21] Appl. No.: 316,844

[22] Filed: Feb. 28, 1989

[51] Int. Cl.[5] ..... F25C 5/08

[52] U.S. Cl. ..... 175/14; 175/18; 299/5

[58] Field of Search ..... 175/14, 17, 18, 11; 299/3, 5; 126/263

[56] References Cited

U.S. PATENT DOCUMENTS

| | | | |
|---|---|---|---|
| 1,165,691 | 12/1915 | Mason | 175/11 |
| 3,620,313 | 11/1971 | Elmore | 175/14 |
| 3,917,007 | 11/1975 | Tsiferov | 175/14 |
| 3,998,749 | 12/1976 | Hydro et al. | 126/263 |
| 4,255,157 | 9/1979 | Yamaguchi et al. | 126/263 |
| 4,425,251 | 1/1984 | Gancy | 126/263 |
| 4,643,166 | 2/1987 | Hubele et al. | 126/263 |
| 4,651,834 | 3/1987 | Eninger et al. | 175/18 |

FOREIGN PATENT DOCUMENTS

| | | | |
|---|---|---|---|
| 977737 | 11/1975 | Canada . | |
| 0471731 | 1/1972 | Japan | 126/263 |
| 0145172 | 9/1982 | Japan | 126/263 |
| 0991016 | 1/1983 | U.S.S.R. | 175/15 |

*Primary Examiner*—Stephen J. Novosad
*Assistant Examiner*—Terry Lee Melius

[57] ABSTRACT

An apparatus and method are described for penetrating ice. The apparatus comprises: (a) a confined thermochemical reaction chamber having an inlet opening and an outlet opening and containing therein a substantially immobilized first thermochemical reactant, (b) flow means connected to said inlet for delivering an aqueous second thermochemical reactant to said reaction chamber for exothermal reaction with the first reactant, and (c) said outlet opening comprising discharge means for delivering hot thermochemical reaction product including hot aqueous fluid and/or steam into contact with the ice to be melted and penetrated. In an alternative design, the inlet and outlet may be a single opening with a cyclic or oscillating exothermic reaction taking place within the reaction chamber.

27 Claims, 1 Drawing Sheet

THERMOCHEMICAL PENETRATOR FOR ICE AND FROZEN SOILS

BACKGROUND OF THE INVENTION

This invention relates to a method and apparatus for penetrating ice, frozen soils and other low-melting solid materials, and more particularly to a thermochemical ice penetrator.

There are many situations in cold climates where it is desirable to penetrate ice cover. For instance, a small hole may be drilled through an ice sheet to determine the thickness of the sheet. It may also be desirable to penetrate an ice sheet for the purpose of carrying electrical, electronic, acoustic, or electroacoustic instrumentation into the ice or into the water beneath the ice sheet. It may furthermore be desirable to provide holes in an ice sheet for the attachment of anchors to anchor instrumentation packages, aircraft, light structures, etc. to ice or frozen soil.

Thermal drilling using steam or hot water is a well-tried and effective method for drilling holes in ice. However, thermal drilling typically requires boilers and pumps of substantial size and weight together with cumbersome insulation around delivery lines. Thus, such a system is not adaptable to the production of a compact, autonomous penetrator required for deployment of small instrument packages.

It is also known to use thermochemical reactions for penetrating ice. One such system is described in Delgendre et al, Canadian Patent No. 977,737, issued Nov. 11, 1975. That patent shows a reactor tube containing a solid propellant which is ignited to produce a hot gas which is then directed against the ice through an outlet.

Eninger et al, U.S. Pat. No. 4,651,834 issued Mar. 24, 1987 describes another form of ice penetrating device in which the penetrator is in the form of an elongated body containing a solid mass of reactant which reacts with water and thereby melts and penetrates the ice. With this system, the reactant mass is consumed lengthwise of the body by its reaction with water, such that the maximum penetration distance of the device through the ice is determined by the length of reactant mass within the penetrator. It functions well only with lithium or lithium alloys as the reactant mass.

There remains a need for a penetrator which is compact, light-weight and simple to use while being highly efficient in penetrating ice with a wide variety of thermochemical reactants.

SUMMARY OF THE INVENTION

The present invention relates to a fluid-transfer ice penetrator comprising:

(a) a confined thermochemical reaction chamber having an inlet opening and an outlet opening and containing therein a substantially immobilized first thermochemical reactant, (b) flow means connected to said inlet for delivering an aqueous second thermochemical reactant to said reaction chamber for exothermal reaction with the first reactant, and (c) said outlet opening comprising discharge means for delivering hot thermochemical reaction product including hot aqueous fluid and/or steam into contact with the ice to be melted and penetrated.

It has been found that steam or water at or near the boiling temperature thermalizes very rapidly with ice, yielding most of its energy in a very short time span. This can be achieved even when there is a substantial physical separation between the ice and the source of hot water.

By utilizing the confined thermochemical reaction chamber according to this invention, there is a very important advantage in that the reaction occurs in a controlled, thermally isolated environment. This allows many more chemicals to be used than is the case for contact penetrators of the type described in U.S. Pat. No. 4,651,834. Thus, the contact penetrators must use chemicals which are reactive at low temperatures, and the reaction products must have good solubility properties in the cold.

The immobilized first thermochemical reactant is preferably a solid, e.g. lithium metal, calcium metal, strontium metal, barium metal, lithium hydride, lithium nitride, lithium imide, calcium nitride, calcium carbide, magnesium nitride, magnesium amide, strontium nitride, barium nitride, magnesium chloride anhydrous, magnesium bromide anhydrous, magnesium iodide anhydrous, calcium hydride, calcium chloride anhydrous, calcium bromide anhydrous, calcium iodide anhydrous, calcium oxide, strontium chloride anhydrous, strontium bromide anhydrous, strontium oxide, stontium nitride, barium hydride, barium chloride anhydrous, barium bromide anhydrous, barium iodide anhydrous, barium oxide, barium nitride, boron triiodide anhydrous, aluminum hydride, sodium aluminum hydride, potassium aluminum hydride, aluminum trichloride anhydrous, aluminum tribromide anhydrous, aluminum triiodide anhydrous, aluminum nitride, aluminum carbide, lithium oxide, lithium chloride anhydrous, lithium bromide anhydrous, lithium iodide anhydrous, sodium borohydride, potassium borohydride and phosphorus pentoxide. The solid reactant may be in the form of rods or strips or in granular form within the reaction vessel. More than one solid reactant may be used as separate solid components or as a mixture of solids.

The aqueous thermochemical reactant is an aqueous fluid selected to react exothermally with a corresponding solid reactant. For instance, an aqueous solution of an acid, such as HCl, HBr, $H_2SO_4$, HI, $CH_3COOH$, an alkali such as LiOH, NaOH, KOH, RbOH, CSOH, or a salt such as $NH_4Cl$, $NH_4Br$, $NH_4I$, $(NH_4)_2SO_4$, $NaHSO_4$, $KHSO_4$ or $NH_4HSO_4$, may be used to react with the aluminum, magnesium or zinc materials. The aluminum or alloy may also react with other aqueous oxidizing solutions (oxidizers), such solutions of $CuCl_2$, $CuBr_2$, $FeCl_2$, $FeCl_3$, $FeBr_2$, $FeBr_3$, $ZnCl_2$, $ZnBr_2$, $CrCl_2$, $CrCl_3$, $CrBr_2$, $CrBr_3$, $MnCl_2$, $MnCl_3$, $MnBr_2$, $CoCl_2$, $CoBr_2$, $CoCl_3$, $NiCl_2$, $NiBr_2$, $SbCl_5$ or ammine complexes thereof. Likewise, the magnesium or alloy may also react with other aqueous solutions, such as solutions of $CuCl_2$, $CuBr_2$, $FeCl_3$, $FeBr_3$, $ZnCl_2$, $ZnBr_2$, etc. Most of these magnesium reactions are greatly enhanced by the presence of $NH_4^+$ in the aqueous solution.

Water may be used as the aqueous reactant when the solid reactant is selected from materials such as lithium metal, calcium metal, barium metal, strontium metal, lithium hydride, lithium nitride, lithium imide, calcium nitride, calcium carbide, magnesium nitride, magnesium amide, strontium nitride, barium nitride, magnesium chloride anhydrous, magnesium bromide anhydrous, magnesium iodide anhydrous, calcium hydride, calcium chloride anhydrous, calcium bromide anhydrous, calcium iodide anhydrous, calcium oxide, strontium chloride anhydrous, strontium bromide anhydrous, strontium oxide, strontium nitride, barium hydride, barium chloride anhydrous, barium bromide anhydrous, barium iodide anhydrous, barium oxide, barium nitride, boron triiodide anhydrous, sodium borohydride, potassium borohydride, aluminum hydride, sodium aluminum hydride, potassium aluminum hydride, aluminum trichloride anhydrous, aluminum tribromide bromide anhydrous, aluminum triiodide anhydrous, aluminum nitride, aluminum carbide, lithium oxide, lithium chloride anhydrous, lithium bromide anhydrous, lithium iodide anhydrous, and phosphorus pentoxide. In some instances, it may be desirable to include additives in the water to depress its freezing point, e.g. methanol or ethylene glycol. The aqueous reactant may also be recirculated melt water. It has also been found that strontium reacts very effectively with an aqueous solution of acetic acid.

When melt water is used as the second reactant, it may be desirable to provide a second solid reactant which dissolves in the melt water to form a solution reactive with the immobilized first reactant. Thus, one metal may be used in the reaction chamber which is attacked by a solution which is formed as recirculating melt water dissolves a water-soluble oxidizer. For instance, melt water alone will not react with magnesium metal, but an aqueous solution formed by contacting the melt water with granular ammonium chloride will react with magnesium metal.

According to one preferred embodiment of the invention, the penetrator is in the form of an elongated body having an inlet in one end thereof and an outlet in the other end. The outlet is preferably in the form of a discharge nozzle through which reaction product, including hot water and/or steam, is directed against the ice surface to be penetrated. With this system, the aqueous second thermochemical reactant can either be a pre-mixed aqueous phase reactant delivered to the reaction vessel from an external reservoir by pressure means or pumping means, or the aqueous second thermochemical reactant can be recirculated melt water.

When the melt water is contacted with a water-soluble oxidizer, this can preferably be done in a separate reaction chamber within the penetrator. A flow connector is provided to transfer the formed solution of oxidizer from the oxidizer reaction chamber into the main thermochemical reaction chamber.

According to another embodiment of the invention, the reaction vessel may remain on the ice surface and a tube and nozzle may carry the hot fluids to the ice/water interface, with only the tube and nozzle penetrating the ice.

When the reaction vessel is in the form of a relatively long narrow tube, the entire tube will move through the ice as the ice is melted. Thus, the hollow tube trailing its liquid reactant tube moves downwardly into the melt water in the ice as it is formed. If the penetrator is denser than the melt water, its own weight can provide the necessary force for the downward movement. If the penetrator is to be operated in an upward direction, and is more buoyant than the melt water, then its own buoyancy can provide the necessary force. Otherwise, a small external force must be applied to move the penetrator into the drilled cavity as it forms.

According to yet another embodiment of this invention, the inlet and outlet may be the same orifice. This functions as a "steam-collapse" or "oscillating" penetrator in which, when the penetrator is submerged, cold water enters the reaction chamber through the orifice. It reacts exothermally with a substantially immobilized reactant within the reaction chamber with the heat of reaction causing the water to boil. The boiling fluid is expelled by steam pressure out through the orifice and melts the ice. At this point, the reaction chamber is filled with steam and, because of the absence of liquid, the exothermal reaction slows or stops. As a result, the reaction chamber cools and the condensation of the steam remaining in the reaction chamber creates a partial vacuum which draws water into the chamber. This cycle of exothermic reaction, expulsion of hot fluid, cooling, and intake of water then may repeat until the ice is penetrated. The reaction product can include gases with a strong negative temperature coefficient of solubility in water, such as ammonia, HCl, sulphur dioxide, etc. This assists in driving the oscillations.

The penetrator is preferably formed with a thermally conductive, e.g. copper or conductive stainless steel, disharge end. The conductive end may also be tapered. This assists in completing passage through the ice after breakthrough and also helps in preventing channeling during passage through the ice.

BRIEF DESCRIPTION OF THE DRAWINGS

Certain preferred embodiments of the invention are illustrated by attached drawings in which.

Figure 1:
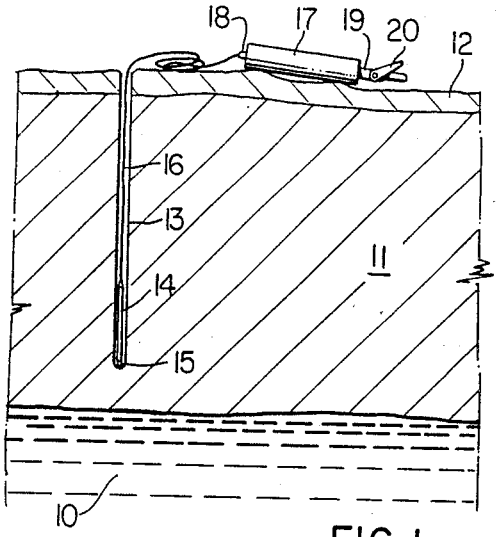
FIG. 1 is a schematic illustration of a typical surface deployed ice penetrator according to the invention.

The device as shown in FIG. 1 can typically be used for penetrating ice of thicknesses up to 4 meters. Thus, it will be seen that a layer of ice 11 rests on the surface of water 10, with some snow 12 on the surface of the ice 11. A hole 13 is being bored through the ice 11 by means of a slender probe 14 attached to a length of flexible tubing 16, e.g. polyethylene tubing or flexible fine stainless steel tubing.

A typical probe 14 is in the form of a hollow cylindrical copper body having a length of about 35 cm, an outside diameter of about 5.2 mm and an inside diameter of about 3.6 mm. The upper part of the probe may be insulated to reduce thermal losses.

The lower end of probe 14 includes a copper tip 15 having a length of about 13 mm beyond the cylindrical body 14 into which it screws. The tip is in the shape of a truncated cone with the lower end having a diameter of about 1.6 mm. The discharge hole has a diameter of about 1.5 mm.

A cylindrical rod of magnesium or aluminum metal is loosely fitted within probe 14 to serve as the solid reactant.

The upper end of tubing 16 is flow connected to a fluid reactant dispenser 17. This includes a reservoir 18 holding the fluid reactant, e.g. aqueous hydrochloric acid containing about 30% by weight HCl. The dispenser also includes a nitrogen or carbon dioxide gas cylinder 19 with a lever 20 for puncturing the cylinder. When the cylinder is punctured, the gas from the gas cylinder pressurizes the reservoir 18, thereby forcing the acid down the tube 16 and into contact with the solid reactant in the probe 14. The dispenser 17 may also include a shut off valve whereby the flow of acid through tube 16 can be stopped and started.

A typical device of this type weighs approximately 2 kg and is easily transported and handled by a single person.

Figure 2:
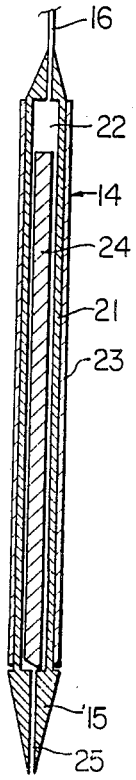
FIG. 2 is a vertical cross-sectional view of a slender probe utilized in the system of FIG. 1.
Figure 3:
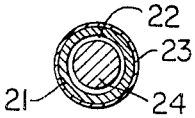
FIG. 3 is a horizontal cross-sectional view of the probe of FIG. 2.

Further details of the probe 14 are shown in FIGS. 2 and 3. Thus, it will be seen that probe 14 has a copper cylindrical wall portion 21 forming therein a reaction chamber 22. The copper body is encased in a thermal insulation 23. Mounted within reaction chamber 22 is magnesium or aluminum metal rod 24 which acts as the immobilized solid reactant. This rod undergoes nonuniform change in dimensions as the reaction progresses.

At the top end of probe 14 is connected the tubing 16 for feeding the aqueous reactant (acid) into the reaction chamber 22. The acid passes down through the reaction chamber 22 contacting the surface of reactant rod 24 whereby the desired thermochemical reaction takes place. The reaction product from the thermochemical reaction passes through the hot fluid outlet nozzle 25 which extends through the copper tip 15. This copper tip is preferably ground to a conical shape with the conical surface being noninsulated to assist in the penetration through the ice.

Figure 4:
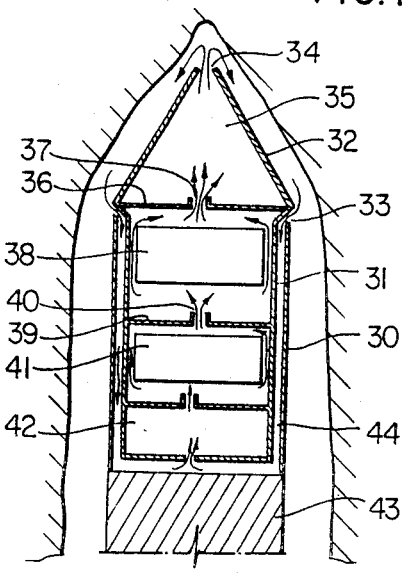
FIG. 4 is a schematic illustration of an arrangement of thermochemical penetrator for upward movement.

A reactor design for penetration in an upward direction is shown in FIG. 4, although it can be used equally well in a downward mode. In this design, the probe comprises a copper tube 30 with a reaction unit 31 mounted within the tube. This reaction unit has a diameter smaller than the inner diameter of tube 30 thereby providing an annular gap between the components.

The reaction unit 31 is connected at its upper end to a conical tip portion 32 with a gap 33 being provided between the tip portion and the top end of tube 30. This tip portion 32 has an outlet opening 34 and a full cavity 35 closed at the lower end by a wall 36 with an inlet 37.

Mounted within the reactor 31 are a first solid reactant 41 and a second solid reactant 38. These reactants are separated by means of a divider wall 39 with a flow conduit 40 extending therethrough. Mounted below the first solid reactant 41 is a pump means 42. The tube 30 also includes the payload 43.

In operation, melt water from the ice cavity flows downwardly and in through inlets 33, passing down through annular gap 44 and entering the inlet of pump means 42. This melt water is then forced upwardly from the pump into contact with the first solid reactant 41 which is a watersoluble oxidizer, e.g. ammonium chloride. This forms an aqueous solution of ammonium chloride which discharges through outlet 40 and into contact with solid reactant 38 which may conveniently be magnesium metal. The contact between the ammonium chloride solution and the magnesium sets up a vigorous thermochemical reaction, emitting steam and hot aqueous solution through outlet 37 into the tip portion to heat the tip walls 32 and discharge through discharge opening 34. The combination of the hot conical tip 32 and the direct discharge of steam and hot aqueous solution through tip 34 quickly melts the ice.

Figure 5:
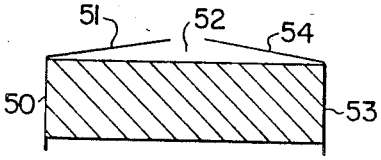
FIG. 5 is a cross-sectional view of the end of an oscillating flow penetrator.

The device shown in FIG. 5 can be described as a steam-collapse, oscillating or cyclic penetrator. Thus, it comprises a vessel with a cylindrical side wall 50 with an end cone portion 51 formed of copper sheet and having an axial orifice 52.

Within the vessel 50 is a substantially immobilized reactant 53 which may, for instance, be essentially monolithic magnesium nitride. A confined reaction zone 54 exists between the immobilized reactant 53 and the orifice 52. With this arrangement, the orifice 52 acts as both an inlet and an outlet to the reaction chamber 54. Thus, the reaction chamber 54 is initially filled by water entering through orifice 52 until the chamber is substantially full. This water confined within reaction chamber 54 then reacts exothermally with the reactant 53, the heat of reaction causing the water to boil, forming hot water, steam, $NH_3$, $SO_2$, HCl, etc. The boiling fluid is discharged through the outlet by the pressure of the steam and other gases, melting the ice. When this happens, the reaction chamber 54 is filled only with steam and, because of the resulting partial or complete absence of aqueous liquid within reaction zone 54, the exothermic reaction with the immobilized reactant 53 slows or stops. As a result, the reaction chamber 54 cools and the condensation of the steam remaining in the reaction chamber creates a partial vacuum which draws a new charge of water into the chamber. This cycle of exothermic reaction, expulsion of hot fluid, cooling, and intake of water then is repeated until the ice is penetrated. Such a system may, for instance, be used in putting sonobuoy float/antennas through relatively thin ice.

Another form of the above oscillating or cyclic penetrator may be one in which only a single charge of water is admitted into the chamber either via the outlet opening or through a valved port. The boiling of the water and/or effervescence of soluble gas then forces hot fluid out into contact with the ice.

The circulation means can be convection. Thus, the necessary buoyant can come from the lower density of hot water than cold water, or from steam bubbles, or from ammonia bubbles or, with certain reactants, from largely insoluble gaseous reaction products such as hydrogen.

While the invention has been described in terms of various preferred embodiments, the skilled artisan will appreciate that various modifications, substitutions, omissions, and changes may be made without departing from the spirit thereof. Accordingly, it is intended that the scope of the present invention be limited solely by the scope of the following claims.

I claim:

1. An ice penetrating device comprising: an enclosed body adapted to move through ice being penetrated, a confined thermochemical reaction chamber formed within said body and containing a substantially immobilized first thermochemical reactant, inlet means for delivering an aqueous second thermochemical reactant to said reaction chamber for controlled exothermal aqueous reaction with said first reactant, and a penetrator tip with a discharge nozzle in fluid communication with said reaction chamber for discharging hot thermochemical reaction product including hot aqueous fluid and/or steam, into contact with the ice to be melted or penetrated.

2. An ice penetrating device according to claim 1 which includes a separate reservoir for said second reactant and transfer means for delivering the second reactant from the reservoir to the thermochemical reaction chamber.

3. An ice penetrating device according to claim 1 which includes recirculating means for recirculating melt water into the reaction chamber.

4. An ice penetrating device according to claim 1 wherein the penetrator is an elongated vessel having said discharge nozzle in an end region thereof for discharge of thermochemical reaction product, said elongated vessel being adapted to penetrate the ice.

5. An ice penetrating device according to claim 4 which includes a separate reservoir for said second reactant and a flexible conduit connecting the reservoir to the reaction chamber.

6. An ice penetrating device according to claim 5 which includes pressure means for delivering said second reactant through the conduit.

7. An ice penetrating device according to claim 5 which includes pumping means for delivering said second reactant through the conduit.

8. An ice penetrating device according to claim 5 which includes valve means for stopping and starting flow of said second reactant.

9. An ice penetrating device according to claim 1 which includes a second reaction chamber flow connected to said thermochemical reaction chamber, said second reaction chamber being adapted to retain a second solid reactant which dissolves in water to form said aqueous second thermochemical reactant.

10. An ice penetrating device according to claim 1 having a thermally conductive end tip containing said discharge nozzle.

11. An ice penetrating device according to claim 10 wherein the conductive end tip is formed of copper or conductive stainless steel.

12. An ice penetrating device according to claim 1 wherein the immobilized first reactant is at least one solid reactant.

13. An ice penetrating device according to claim 12 wherein the first reactant is aluminum, magnesium, zinc or alloys thereof.

14. An ice penetrating device according to claim 12 wherein the first reactant is lithium metal, calcium metal, strontium metal or barium metal or alloys thereof or alloys of these metals with aluminum, magnesium or zinc.

15. An ice penetrating device according to claim 1 wherein the inlet means and discharge nozzle are the same orifice.

16. An ice penetrating device according to claim 1 wherein the reaction chamber is thermally insulated.

17. A process for penetrating ice which comprises;

providing a thermochemical reaction vessel having a confined thermochemical reaction zone and a penetrator tip, said confined reaction zone including an inlet means and an outlet means, said outlet means including a discharge nozzle, within said penetrator tip, in fluid communication with said confined reaction zone, providing said confined reaction zone with a substantially immobilized first thermochemical reactant, flowing an aqueous second thermochemical reactant in through said inlet means and into contact with said first thermochemical reactant to cause a controlled thermochemical reaction within the confined reaction zone with the production of steam and hot aqueous fluid and discharging the reaction product, including the steam and hot aqueous fluid, through said discharge nozzle into contact with ice to be penetrated.

18. A process according to claim 17 wherein the first reactant is aluminum, magnesium, zinc or alloys thereof.

19. A process according to claim 18 wherein the second reactant is an aqueous solution of $CuCl_2$, $CuBr_2$, $FeCl_2$, $FeCl_3$, $FeBr_2$, $FeBr_3$, $ZnCl_2$, $ZnBr_2$, $CrCl_2$, $CrCl_3$, $CrBr_2$, $CrBr_3$, $MnCl_2$, $MnCl_3$, $MnBr_2$, $CoCl_2$, $CoBr_2$, $CoCl_3$, $NiCl_2$, $NiBr_2$, $SbCl_5$, HCl, HBr, HI, $H_2SO_4$, $CH_3COOH$, LiOH, NaOH, KOH, RbOH, CsOH, $NH_4Cl$, $NH_4Br$, $NH_4I$, $(NH_4)_2SO_4$, $NaHSO_4$, $KHSO_4$ or $NH_4HSO_4$.

20. A process according to claim 17 wherein the first reactant is selected from lithium metal, calcium metal, strontium metal, barium metal, lithium hydride, lithium nitride, lithium imide, calcium nitride, calcium carbide, magnesium nitride, magnesium amide, strontium nitride, barium nitride, magnesium chloride anhydrous, magnesium bromide anhydrous, magnesium iodide anhydrous, calcium hydride, calcium chloride anhydrous, calcium bromide anhydrous, calcium iodide anhydrous, calcium oxide, strontium chloride anhydrous, strontium bromide anhydrous, strontium oxide, stontium nitride, barium hydride, barium chloride anhydrous, barium bromide anhydrous, barium iodide anhydrous, barium oxide, barium nitride, boron triiodide anhydrous, aluminum hydride, sodium aluminum hydride, potassium aluminum hydride, aluminum trichloride anhydrous, aluminum tribromide anhydrous, aluminum triiodide anhydrous, aluminum nitride, aluminum carbide, lithium oxide, lithium chloride anhydrous, lithium bromide anhydrous, lithium iodide anhydrous, sodium borohydride, potassium borohydride and phosphorus pentoxide.

21. A process according to claim 20 wherein the second reactant is water.

22. A process according to claim 18 wherein the second reactant is an aqueous solution of $CuCl_2$, $CuBr_2$, $FeCl_2$, $FeCl_3$, $FeBr_2$, $FeBr_3$, $ZnCl_2$, $ZnBr_2$, $CrCl_2$, $CrCl_3$, $CrBr_2$, $CrBr_3$, $MnCl_2$, $MnCl_3$, $MnBr_2$, $CoCl_2$, $CoBr_2$, $CoCl_3$, $NiCl_2$, $NiBr_2$, $SbCl_5$, HCl, HBr, HI, $H_2SO_4$, $CH_3COOH$, LiOH, NaOH, KOH, RbOH, CsOH, $NH_4Cl$, $NH_4Br$, $NH_4I$, $(NH_4)_2SO_4$, $NaHSO_4$, $KHSO_4$or $NH_4HSO_4$.

23. A process according to claim 22 wherein the second reactant is an aqueous solution formed by contacting water with a water-soluble reactant contained in a reaction zone adjacent said confined thermochemical reaction zone.

24. A process according to claim 22 wherein the aqueous solution contains ammonium ion.

25. A process according to claim 17 wherein the thermochemical reaction takes place in a cyclic manner with a charge of aqueous reactant being drawn in to the reaction zone, reacting with the immobilized reactant and the reaction product including steam and hot aqueous fluid being discharged to complete a cycle.

26. A process according to claim 25 wherein the charge of aqueous reactant and the discharge of reaction product takes place through the same orifice.

27. A process according to claim 26 wherein the aqueous reactant is water.

* * * * *